US010961688B2

(12) United States Patent
Izumi et al.

(10) Patent No.: US 10,961,688 B2
(45) Date of Patent: Mar. 30, 2021

(54) CONSTRUCTION MACHINE

(71) Applicant: KOBELCO CONSTRUCTION MACHINERY CO., LTD., Hiroshima (JP)

(72) Inventors: Ryota Izumi, Hiroshima (JP); Satoshi Kurushima, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 0 days.

(21) Appl. No.: 16/964,248

(22) PCT Filed: Dec. 21, 2018

(86) PCT No.: PCT/JP2018/047385
§ 371 (c)(1),
(2) Date: Jul. 23, 2020

(87) PCT Pub. No.: WO2019/155772
PCT Pub. Date: Aug. 15, 2019

(65) Prior Publication Data

US 2021/0040712 A1 Feb. 11, 2021

(30) Foreign Application Priority Data

Feb. 7, 2018 (JP) ..... JP2018-019960

(51) Int. Cl.
*E02F 9/08* (2006.01)
*E02F 9/22* (2006.01)
*E02F 9/12* (2006.01)

(52) U.S. Cl.
CPC ..... *E02F 9/0875* (2013.01); *E02F 9/0866* (2013.01); *E02F 9/121* (2013.01); *E02F 9/2267* (2013.01)

(58) Field of Classification Search
None
See application file for complete search history.

(56) References Cited

U.S. PATENT DOCUMENTS 8,186,156 B2 * 5/2012 Kamiya ..... E02F 9/00 60/420
9,422,691 B2 * 8/2016 Ueta ..... E02F 9/2267
(Continued)

FOREIGN PATENT DOCUMENTS

JP 2015-183378 A1 10/2015
JP 2015-197030 A 11/2015
(Continued)

OTHER PUBLICATIONS

International Search Report dated Mar. 26, 2019 in PCT/JP2018/047385 filed Dec. 21, 2018, 1 page.

*Primary Examiner* — Michael Leslie
*Assistant Examiner* — Michael Quandt
(74) *Attorney, Agent, or Firm* — Oblon, McClelland, Maier & Neustadt, L.L.P.

(57) ABSTRACT

To enable maintenance of a control valve in a narrow space, on a slewing frame an engine is disposed at a rear portion, a swivel joint is disposed between a pair of vertical plates, a slewing motor is disposed diagonally behind the swivel joint between the paired vertical plates, and a control valve is disposed diagonally behind the swivel joint between the paired vertical plates and forward of the engine. A detachment direction A of a plurality of spools of the control valve extends obliquely in such a way as to get closer to a right vertical plate as it goes rearward.

6 Claims, 6 Drawing Sheets

(56) References Cited

U.S. PATENT DOCUMENTS

| | | | | |
|---|---|---|---|---|
| 2015/0267379 | A1 | 9/2015 | Ueta | |
| 2015/0337969 | A1 | 11/2015 | Choi et al. | |
| 2020/0256037 | A1* | 8/2020 | Kashima | E02F 9/2267 |

FOREIGN PATENT DOCUMENTS

| | | | |
|---|---|---|---|
| JP | 2016-3443 | A | 1/2016 |
| JP | 5929932 | B2 | 6/2016 |
| JP | 2017-160738 | A | 9/2017 |

* cited by examiner

CONSTRUCTION MACHINE

TECHNICAL FIELD

The present invention relates to a construction machine including a lower traveling body, a slewing frame rotatably mounted on the lower traveling body and having a pair of vertical plates, an attachment supported on the pair of vertical plates of the slewing frame in a raisable and lowerable manner, and a control valve. In particular, the present invention relates to an arrangement position of the control valve of the construction machine.

BACKGROUND ART

There are conventional construction machines that include a slewing frame, a pair of vertical plates disposed on the slewing frame, and an attachment supported on the pair of vertical plates in a raisable and lowerable manner, such as a hydraulic excavator. For example, Patent Literature 1 discloses a construction machine in which a swivel joint, a stewing motor, and a control valve are longitudinally aligned in a front-rear direction in a narrow area between the paired vertical plates. In addition, an engine is disposed on a portion of the slewing frame located behind the control valve. Maintenance, such as replacement of spools of the control valve, is performed using the space (a space for maintenance or a space for attachment and detachment) defined between the control valve and the engine.

CITATION LIST

Patent Literature

Patent Literature 1: Japanese Patent No. 5929932

SUMMARY OF INVENTION

By the way, in recent years, there has been an increase in size of engines due to demands for performance of constriction machines.

This has raised a problem that since the space for maintenance defined behind the control valve, which was sufficiently secured in old model construction machines, cannot be secured, it is extremely difficult to perform maintenance on the control valve.

The present invention has been made in view of the above-mentioned problem, and it is an object of the present invention to enable maintenance of the control valve in the limited space between the paired vertical plates by arranging components in an innovative way.

In order to achieve the above-mentioned object, in the present invention, the control valve is disposed on the slewing frame such that a detachment direction of the spools of the control valve extends obliquely with respect to the vertical plates.

Specifically, the present invention provides a construction machine, comprising: a lower traveling body; a slewing frame rotatably mounted on the lower traveling body about a rotational axis extending in an up-down direction, the slewing frame having an upper surface extending in a front-rear direction and a left-right direction; a first vertical plate and a second vertical plate disposed on the upper surface of the slewing frame at a distance from each other across the rotational axis in the left-right direction, each of the vertical plates extending in the front-rear direction and the first vertical plate being located closer to the rotational axis in the left-right direction than the second vertical plate; an attachment disposed forward of the rotational axis and supported on the first vertical plate and the second vertical plate in a raisable and lowerable manner; an engine mounted on a portion of the upper surface of the slewing frame located behind the first vertical plate and the second vertical plate; a swivel joint attached to the slewing frame such that the swivel joint lies on the rotational axis between the first vertical plate and the second vertical plate, the swivel joint being interposed between the lower traveling body and the slewing frame; a slewing motor mounted on a portion of the upper surface of the slewing frame located behind the swivel joint and closer to the second vertical plate than to the first vertical plate in the left-right direction, the slewing motor being configured to generate a driving force for rotating the stewing frame; and a control valve including a control valve body mounted on a portion of the upper surface of the slewing frame located behind and at a distance from the slewing motor and in front of and at a distance from the engine, the portion being located between the first vertical plate and the second vertical plate at a position closer to the first vertical plate than to the second vertical plate in the left-right direction, and a plurality of spools each detachably supported on the control valve body, the spools being detachable from the control valve body in a horizontal detachment direction through an attachment and detachment space defined between the control valve body and the engine, the detachment direction extending obliquely with respect to the front-rear direction in such a way as to bring the plurality of spools closer to the second vertical plate as the spools proceed rearward in the detachment direction.

DESCRIPTION OF EMBODIMENTS

Figure 1:
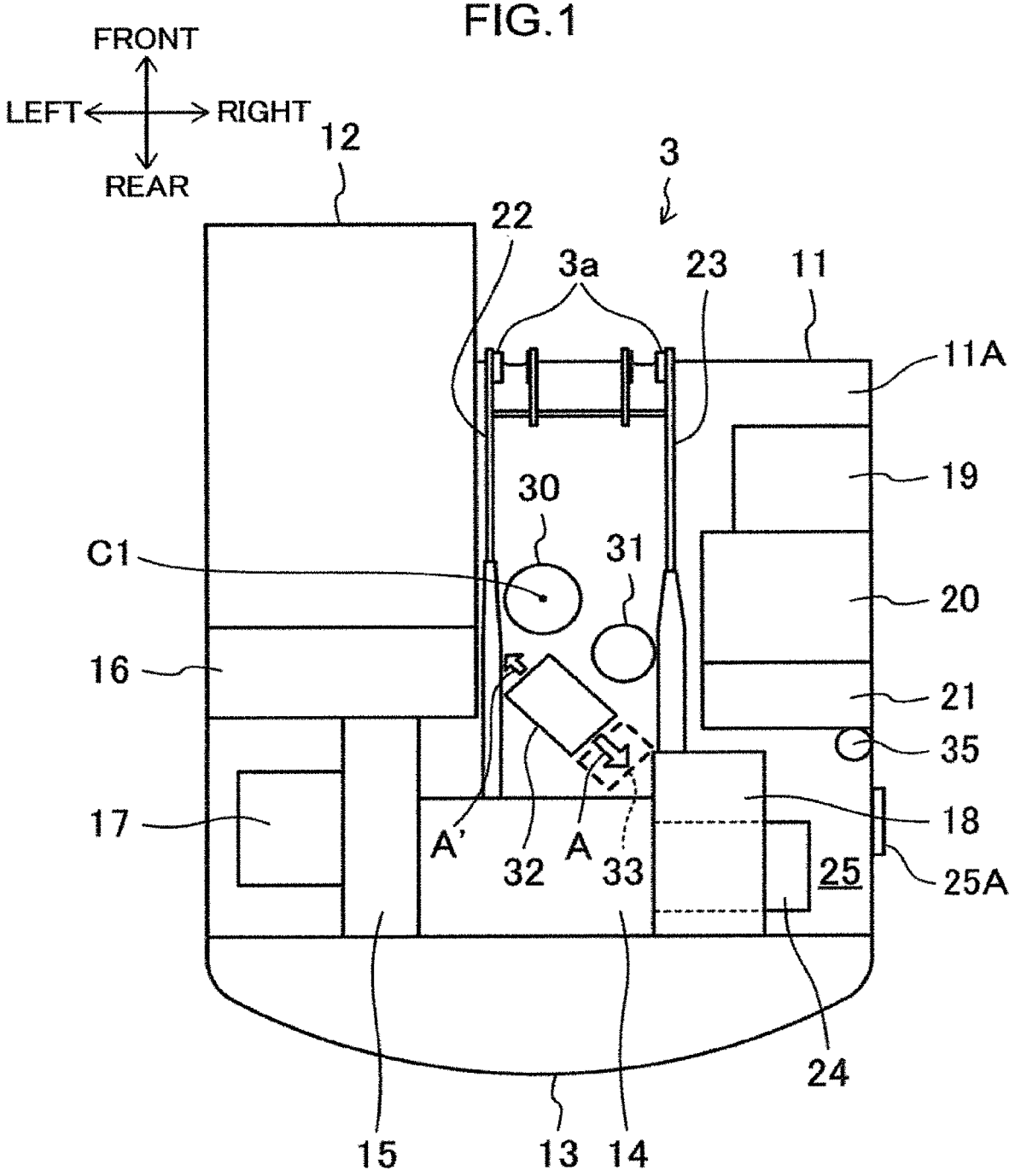
FIG. 1 is a schematic plan view showing arrangement of components of an upper slewing body of a construction machine according to an embodiment of the present invention.
Figure 2:
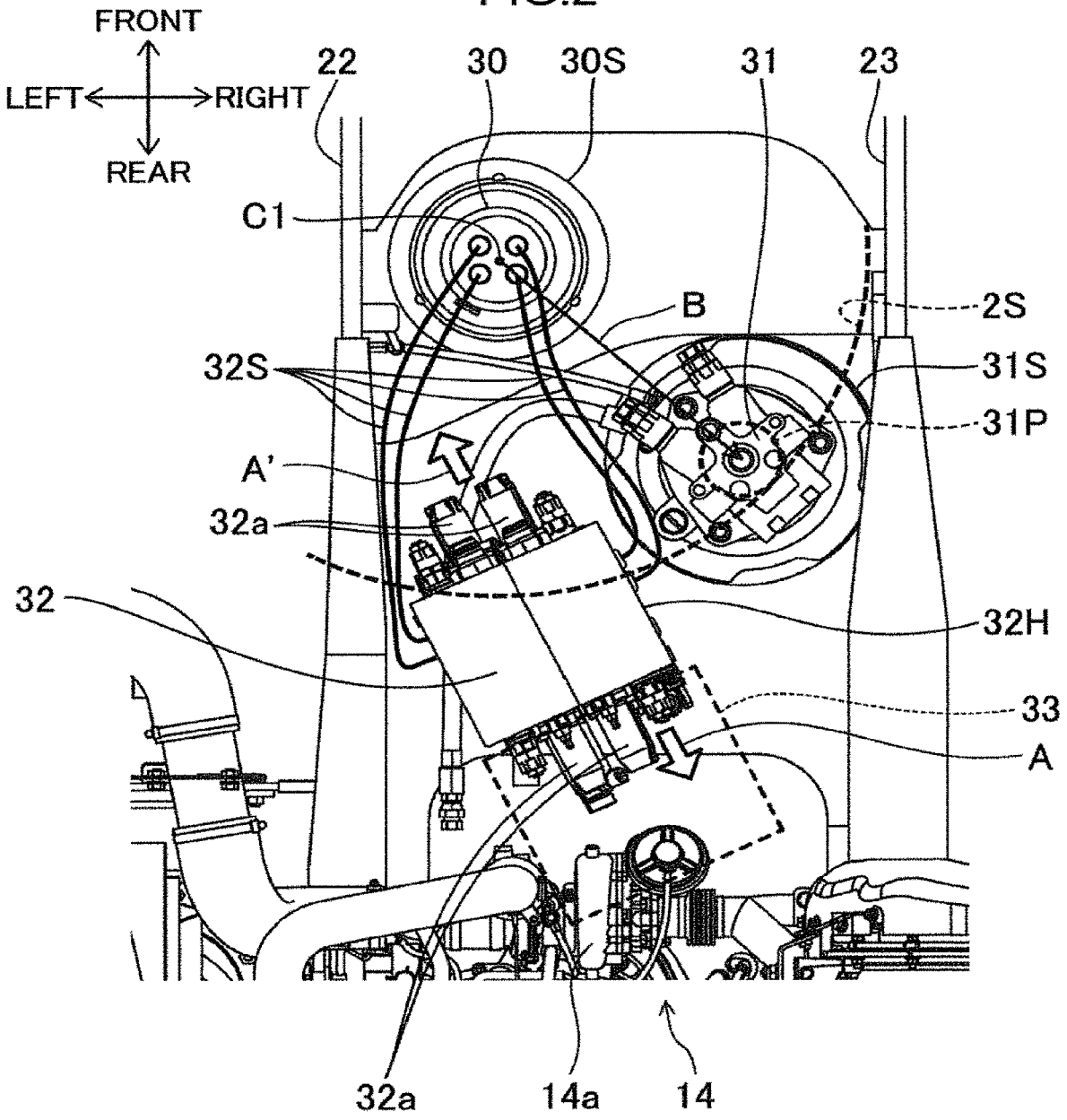
FIG. 2 is an enlarged plan view showing the vicinity of a control valve of the construction machine according to the embodiment of the present invention.
Figure 3:
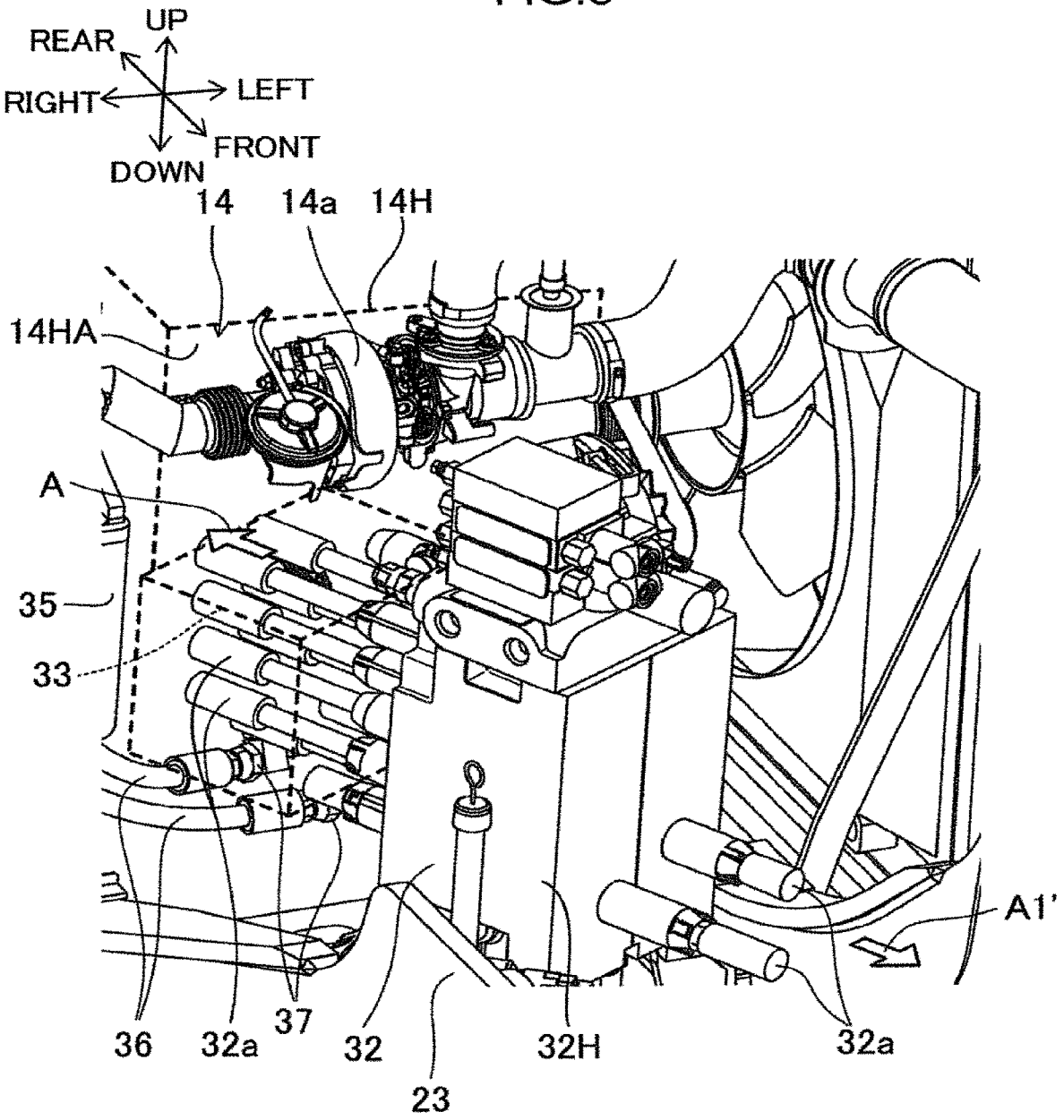
FIG. 3 is an enlarged perspective view showing the vicinity of the control valve of the construction machine according to the embodiment of the present invention.
Figure 4:
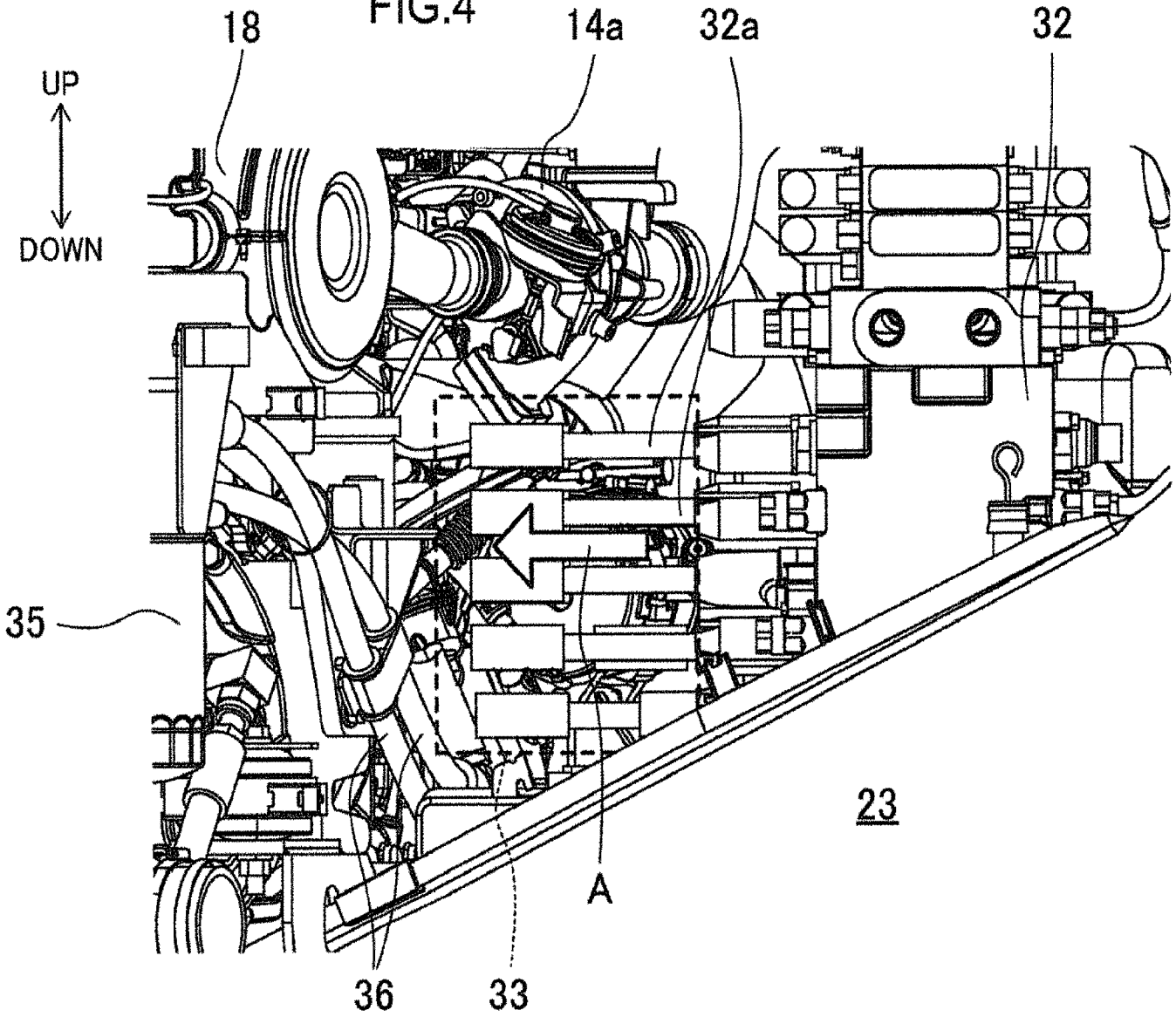
FIG. 4 is an enlarged side view showing the vicinity of the control valve of the construction machine according to the embodiment of the present invention.
Figure 5:
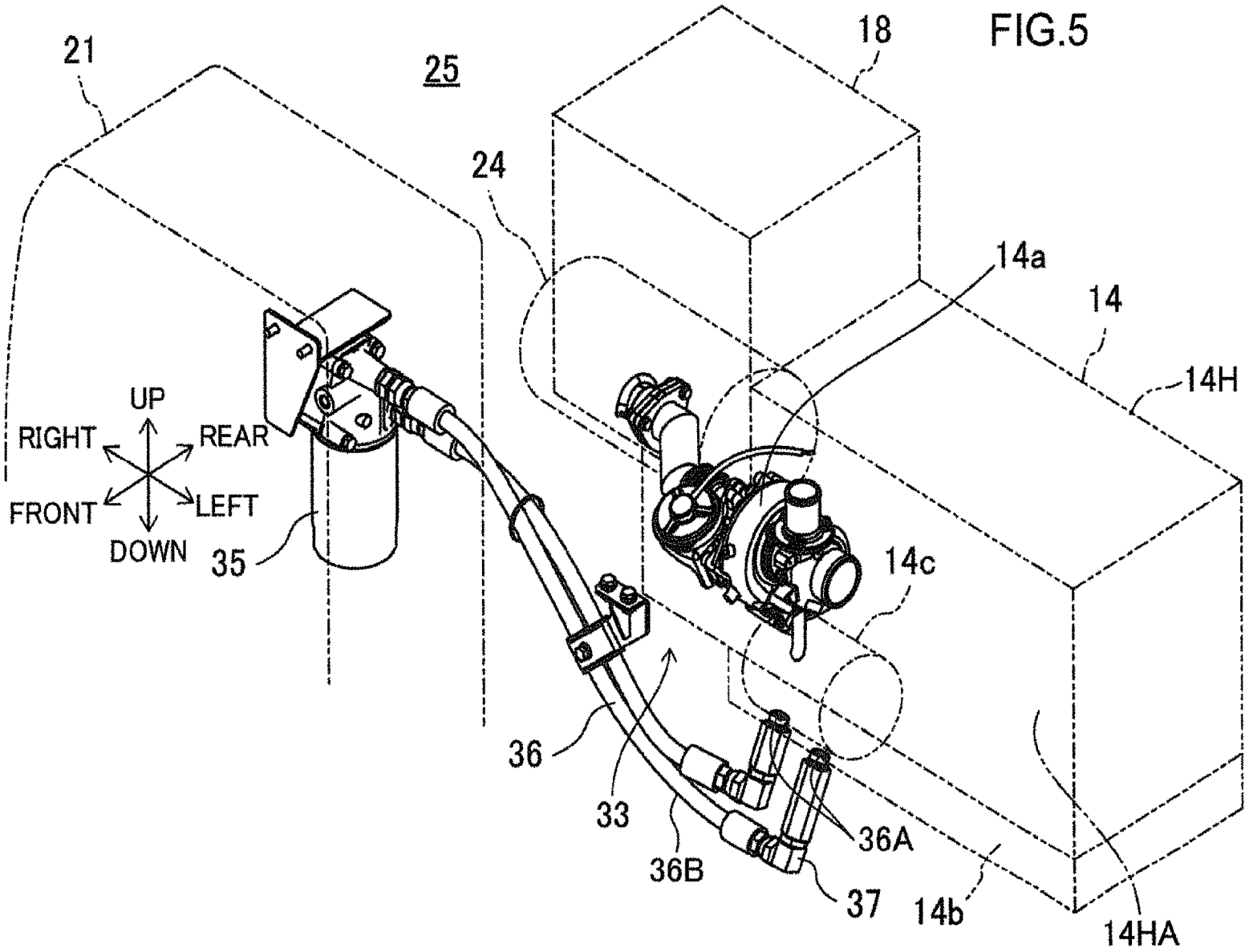
FIG. 5 is an enlarged perspective view showing a turbo mechanism, an oil filter, engine oil circulation piping, and L-shaped connectors of the construction machine according to the embodiment of the present invention.
Figure 6:
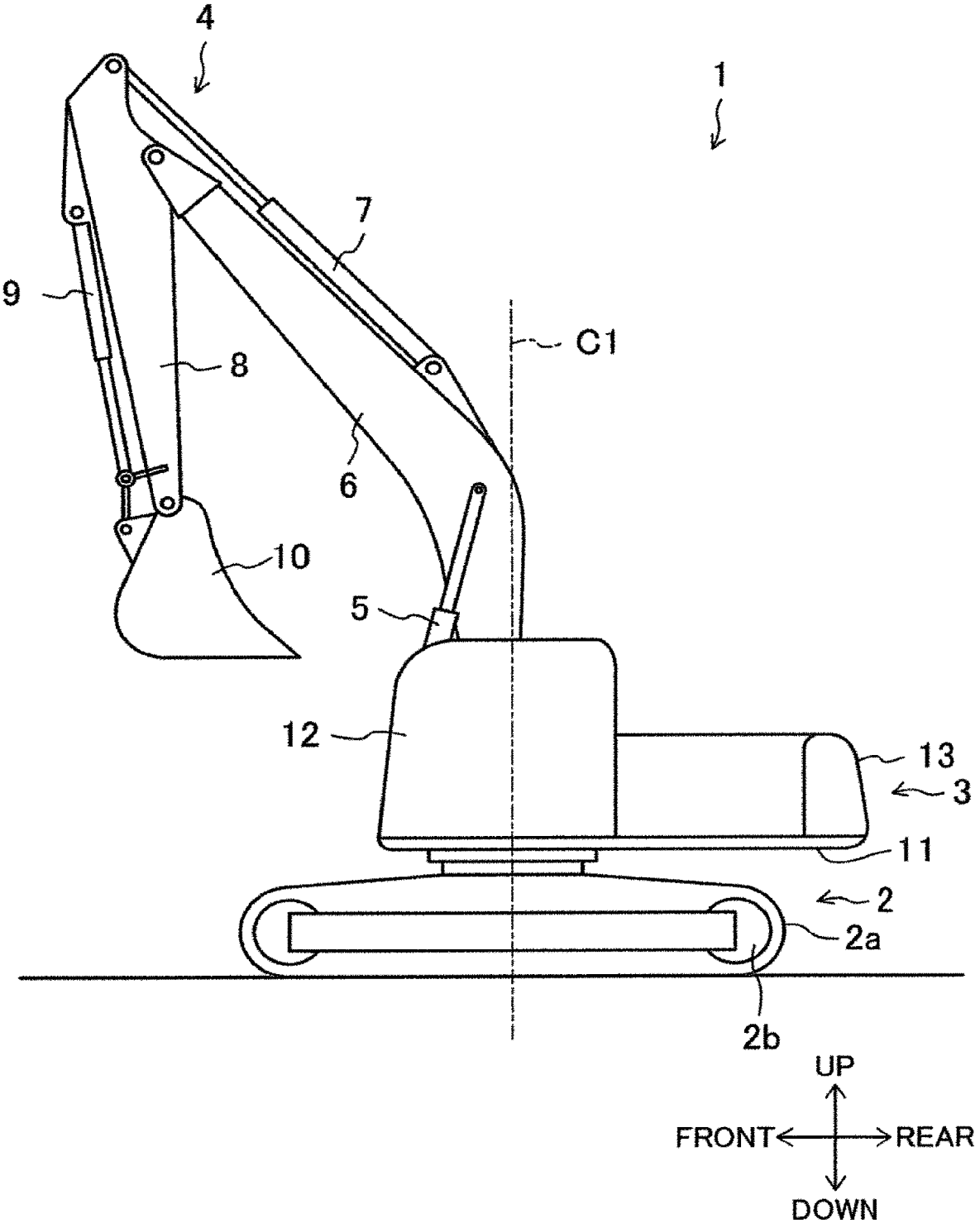
FIG. 6 is a side view of a hydraulic excavator serving as an example of the construction machine according to the embodiment of the present invention.

Hereinafter, an embodiment of the present invention will be described with reference to the accompanying drawings. FIG. 1 is a schematic plan view showing arrangement of components of an upper slewing body 3 of a hydraulic excavator 1 (a construction machine) according to the embodiment of the present invention. FIG. 2 is an enlarged plan view showing the vicinity of a control valve 32 of the hydraulic excavator 1. FIG. 3 is an enlarged perspective view showing the vicinity of the control valve 32 of the hydraulic excavator 1. FIG. 4 is an enlarged side view showing the vicinity of the control valve 32 of the hydraulic excavator 1. FIG. 5 is an enlarged perspective view showing a turbo mechanism 14*a*, an oil filter 35, engine oil circulation piping 36, and an L-shaped connectors 37 of the hydraulic excavator 1. FIG. 6 is a side view of the hydraulic excavator 1 serving as an example of the construction machine according to the embodiment of the present invention.

As shown in FIG. 6, the hydraulic excavator 1 includes a lower traveling body 2 equipped with a travelling means such as a crawler track 2*a*, and the upper slewing body 3 supported on the lower traveling body 2 in such a way as to be able to slew about a slewing axis C1 (a rotational axis) extending in an up-down direction. The upper slewing body 3 includes a stewing frame 11 and a pair of vertical plates 22 and 23. The slewing frame 11 has an upper surface 11A (FIG. 1) facing upward and extending in a front-rear direction and a left-right direction of the upper slewing body 3 (the hydraulic excavator 1). When the upper slewing body 3 is stewed with respect to the lower traveling body 2, the upper stewing body 3 and the lower traveling body 2 have different front-rear directions and different left-right directions. Accordingly, the directions shown in FIGS. 1 through 6 are defined with respect to the upper stewing body 3. As shown in FIG. 1, for example, the pair of vertical plates 22 and 23 are disposed in a standing manner on a central portion of the slewing frame 11 of the upper stewing body 3 in the left-right direction. The paired vertical plates 22 and 23 are disposed on the upper surface 11A of the slewing frame 11 at a distance from each other across the stewing axis C1 (FIG. 6) in the left-right direction, each extending in the front-rear direction. The vertical plate 22 (a first vertical plate), which is the left one of (one of) the pair of vertical plates 22 and 23, is disposed closer to the stewing axis C1 in the left-right direction than the vertical plate 23 (a second vertical plate), which is the right one of (the other of) the pair of vertical plates 22 and 23.

The paired vertical plates 22 and 23 have respective front ends located forward of the slewing axis C1 and to which a boom foot 3*a* is attached. On the boom foot 3*a*, an attachment 4 is supported in a raisable and lowerable manner.

For example, the attachment 4 includes a lower boom 6 pivotally driven by a boom cylinder 5, an arm 8 connected to a distal end of the lower boom 6 and pivotally driven by an arm cylinder 7, and a bucket 10 connected to a distal end of the arm 8 and pivotally driven by a bucket cylinder 9. It should be noted that the attachment 4 is not limited to this configuration.

The hydraulic excavator 1 further includes an operator's cab 12, a counterweight 13, an engine 14, a radiator 15, an air cleaner 16, a battery 17, an exhaust treatment device 18, a urea tank 19, a fuel tank 20, a hydraulic oil tank 21, a hydraulic oil pump 24, and a pump casing 25.

The upper slewing body 3 has the slewing frame 11, and the operator's cab 12 is disposed at the left side of the pair of vertical plates 22 and 23, as shown in FIG. 1. The counterweight 13 is disposed behind the pair of vertical plates 22 and 23 at a predetermined distance therefrom. The engine 14 is disposed behind the pair of vertical plates 22 and 23 and in front of the counterweight 13, the engine 14 being horizontally disposed with its length extending in the left-right direction. The radiator 15, the air cleaner 16, and the battery 17 are disposed at the left side of the engine 14, and the exhaust treatment device 18 is disposed at the right side of the engine 14. The engine 14 is mounted on a portion of the upper surface 11A of the slewing frame 11 located behind the pair of vertical plates 22 and 23. The urea tank 19, for example, which is used for the exhaust treatment device 18, is disposed at a right front portion of the slewing frame 11, and the fuel tank 20 and the hydraulic oil tank 21 are disposed behind the urea tank 19. The hydraulic pump 24, used for circulating (discharging) a hydraulic oil, is disposed under the exhaust treatment device 18 and at the right side of the engine 14. The pump casing 25, which houses the hydraulic pump 24, is formed at the right side of the engine 14.

The lower traveling body 2 and the upper slewing body 3 are connected by hydraulic piping via a swivel joint 30. The swivel joint 30 is attached to the slewing frame 11 such that it lies on the slewing axis C1 between the paired vertical plates 22 and 23, the swivel joint 30 being interposed between the lower traveling body 2 and the slewing frame 11 of the upper slewing body 3. Thus, in plan view of the upper slewing body 3, the swivel joint 30 is located closer to the vertical plate 22 than to the vertical plate 23 in the left-right direction (FIG. 1).

A slewing motor 31 is mounted on a portion of the upper surface 11A of the slewing frame 11 located behind the swivel joint 30 and closer to the right vertical plate 23 than to the left vertical plate 22 in the left-right direction, and is configured to generate a driving force (a torque) for rotating the slewing frame 11. The upper slewing body 3 is driven to slew by the torque of the slewing motor 31.

The control valve 32 is configured to control various hydraulic devices including the slewing motor 31. For example, four pipes 32S (FIG. 2) connect a hydraulic component of the crawler track 2*a* of the lower traveling body 2, such as a travelling motor 2*b* (FIG. 6), to the control valve 32 via the swivel joint 30. It should be noted that in FIG. 3, the ports of the control valve 32 for connecting the hydraulic piping are omitted for simplicity.

The control valve 32 includes a control valve body 32H and a plurality of spools 32*a*. The control valve body 32H is mounted on a portion of the upper surface 11A of the slewing frame 11 located behind the slewing motor 31 at a predetermined distance therefrom and in front of the engine 14 at a predetermined distance therefrom, the portion being located between the paired vertical plates 22 and 23 at a position closer to the left vertical plate 22 than to the right vertical plate 23 in the left-right direction. The plurality of spools 32*a* are detachably supported on the control valve body 32H, the spools 32*a* being detachable from the control valve body 32H in a horizontal detachment direction through an insertion and removal space 33 (an attachment and detachment space) defined between the control valve body 32H and the engine 14. As shown in FIG. 2, a detachment direction. A of the plurality of spools 32*a* is set to be oblique with respect to the front-rear direction, getting closer to the right vertical plate 23 as it goes rearward. In addition, the relative sizes of the spools 32*a* and the insertion and removal space 33 are schematically shown in FIG. 2. The spools 32*a* can be attached to and detached from the control valve body 32H through the insertion and removal space 33.

The above-described configuration can alternatively be described as follows. The swivel joint 30 is disposed on the slewing axis C1 of the slewing frame 11 between the paired vertical plates 22 and 23. The slewing motor 31 is disposed diagonally behind the swivel joint 30 between the paired vertical plates 22 and 23. The control valve 32 is disposed behind the swivel joint 30 (or diagonally behind the slewing motor 31) between the paired vertical plates 22 and 23 and forward of the engine 14. In this manner, in the present embodiment, the swivel joint 30, the slewing motor 31, and the control valve 32 are not longitudinally aligned but staggered, thereby making it possible to place these components in the narrow space between the paired vertical plates 22 and 23.

More specifically, the swivel joint 30 and the control valve 32 are disposed near the left vertical plate 22, and the slewing motor 31 is disposed near the right vertical plate 23. The control valve 32 is disposed such that the detachment direction A (indicated by the white arrow shown in, for example, FIG. 1) of the plurality of spools 32*a* included therein extends obliquely to bring the plurality of spools 32*a* closer to the right vertical plate 23 as the spools 32*a* proceed rearward.

In an alternative description, as shown in the enlarged view of FIG. 2, the detachment direction A of the plurality of spools 32*a* extends obliquely along the straight line B connecting the center of the swivel joint 30 and the center of the slewing motor 31. The attachment direction A and the straight line B may or may not necessarily extend in parallel to each other. They may slightly intersect each other. In plan view, a straight line extending in the detachment direction A of the plurality of spools 32*a* and the slewing motor 31 are relatively positioned such that they do not overlap each other. In other words, the slewing motor 31 is disposed in plan view at a position horizontally away from a plurality of straight lines passing through respective ones of the plurality of spools 32*a* and extending in the detachment direction A.

The engine 14 includes an engine body 14H having a front surface 14HA (FIGS. 3 and 5) facing forward in the front-rear direction, and a turbo mechanism 14*a*. The turbo mechanism 14*a* is attached to the front surface 14HA of the engine body 14H.

As shown in FIG. 2, the turbo mechanism 14*a* of the engine 14 is disposed in front of the plurality of spools 32*a* in the detachment direction A in plan view. On the other hand, as shown in FIGS. 3 and 4 illustrating the spools 32*a* being pulled out, the turbo mechanism 14*a* is disposed, in side view as seen in the left-right direction, above the insertion and removal space 33 for the plurality of spools 32*a*. Thus, the turbo mechanism 14*a* is disposed, in plan view, on at least one of the plurality of straight lines passing through the respective ones of the plurality of spools 32*a* and extending in the detachment direction A and, in side view, above the at least one straight line.

As shown in FIGS. 1 and 5, the engine 14 further includes an engine oil pan 14*b*, disposed under the engine body 14H, for containing an engine oil, and an engine oil pump 14*c*. The engine oil pump 14*c* is disposed under the engine body 14H in such a way as to overlap the insertion and removal space 33 (the attachment and detachment space) in rear view of the slewing frame 11, and is configured to suck and discharge the engine oil to circulate the engine oil in the engine oil pan 14*b*.

As mentioned above, the engine oil pump 14*c* is disposed at a height at which it overlaps the insertion and removal space 33 for the plurality of spools 32*a* in rear view.

The upper slewing body 3 of the hydraulic excavator 1 includes the oil filter (an engine oil filter) and the engine oil circulation piping 36.

The hydraulic oil tank 21 is disposed in front of the engine 14 and at the right side of the control valve 32. The hydraulic oil tank 21 has an upper side surface facing the above-mentioned pump casing 25, to which the oil filter 35 is attached. Thus, the oil filter 35 is disposed at a portion of the slewing frame 11 outside the right vertical plate 23 in the left-right direction, for filtering the engine oil.

The engine oil circulation piping 36 extends from the engine oil pump 14*c* to the oil filter 35 attached to the upper part of the hydraulic oil tank 21. The engine oil circulation piping 36 is connected to the engine oil pump 14*c* at a low position via the L-shaped connectors 37 extending downward from the engine oil pump 14*c* and serving as extension connectors. The engine oil circulation piping 36 bypasses the insertion and removal space 33 and has upper ends connected to the oil filter 35 located at a higher position. Thus, the engine oil circulation piping 36 permits flow of the engine oil between the engine oil pump 14*c* and the oil filter 35. The engine oil circulation piping 36 has one end portions 36A (FIG. 5) connected to the engine oil pump 14*c* and guide pipes 36B extending from respective ones of the one end portions 36A to the oil filter 35, passing through under the insertion and removal space 33.

With reference to FIG. 1, the pump casing 25 is disposed on a portion of the upper surface 11A of the slewing frame 11 located outside the engine 14 in the left-right direction (at the right side of the engine 14). The pump casing 25 includes a door 25A (FIG. 1) openable to permit a worker to enter into the pump casing 25 from outside the slewing frame 11. The pump casing 25 houses the oil filter 35 in addition to the hydraulic pump 24 for circulating the hydraulic oil.

As described above, in the present embodiment, the space left open in front of the engine 14 is used as the insertion and removal space 33 and, moreover, the detachment direction A (an insertion and removal direction) of the spools 32*a* extends obliquely with respect to the pair of vertical plates 22 and 23 (the front-rear direction). This makes it possible, even when the control valve 32 has a defect and there is a need to perform maintenance on its spools 32*a*, to sufficiently secure the insertion and removal space 33 and thereby facilitate the attachment and detachment of the spools 32*a*.

In addition, the space left behind the slewing motor 31 disposed near the right vertical plate 23 can be effectively used as the attachment and detachment space for the spools 32*a* of the control valve 32. In other words, there may be a case where attaching and detaching the spools 32*a* to and from the control valve body 32H in the front-rear direction would necessitate moving the spools 32*a* through a distance sufficient to bring them into contact with the engine 14 located therebehind. Even in such a case, detaching (attaching and detaching) the spools 32*a* in the detachment direction A makes it possible to attach and detach the spools 32*a* in the limited space.

Here, with reference to FIG. 2, the swivel joint 30 is attached to a swivel joint attaching portion 30S disposed on the upper surface 11A of the slewing frame 11. The slewing motor 31 is attached to a slewing motor attaching portion 31S disposed on the upper surface 11A. The slewing motor 31 includes an unillustrated motor shaft projecting downward and a pinion 31P secured to a distal end of the motor shaft. The pinion 31P meshes with gear teeth formed on the inner surface of a slewing bearing 2S secured to the lower traveling body 2. Consequently, driving the slewing motor 31 causes the upper slewing body 3 including the slewing frame 11 to slew with respect to the lower traveling body 2. Therefore, in order to allow the engagement between the pinion 31P and the slewing bearing 2S, the slewing motor 1 needs to be disposed on the dashed circle (2S) in FIG. 2. In disposition of the slewing motor 31 on the above-mentioned dashed circle and between the paired vertical plates 22 and 23, disposing the slewing motor 31 near the right vertical plate 23 as shown in FIG. 2 makes it possible to locate the slewing motor 31 more forward than the case of disposing the slewing motor 31 directly behind the swivel joint 30. This makes it possible to sufficiently secure the insertion and removal space 33 for the spools 32*a* of the control valve 32. In addition, as shown in FIG. 2, disposing the swivel joint 30 and the control valve 32 near the left vertical plate 22 and the stewing motor 31 near the right vertical plate 23 makes it possible to allow the plurality of (the four) pipes 32S, extending from the control valve 32 to the swivel joint 30 (the lower traveling body 2), to pass by the side of the slewing motor 31. This prevents the plurality of pipes 32S from extending at the left and right sides of the slewing motor 31, thereby making it possible to shorten the lengths of the plurality of pipes 32S.

In addition, in the present embodiment, the rear edge of the swivel joint attaching portion 30S (in a circular shape) is located rearward of the front edge of the slewing motor attaching portion 31S (in a circular shape), as shown in FIG. 2. Thus, the swivel joint attaching portion 30S and the slewing motor attaching portion 31S overlap each other in the front-rear direction. Similarly, the front edge of the control valve 32 is located forward of the rear edge of the slewing motor attaching portion 31S (in the circular shape). Thus, stewing motor attaching portion 31S and the control valve 32 overlap each other in the front-rear direction. In this manner, the swivel joint attaching portion 30S and the control valve 32 are disposed in the space adjacent to the slewing motor attaching portion 31S, being brought from the front and the rear. This makes it possible to reduce the size of the space occupied by the swivel joint 30, the slewing motor 31, and the control valve 32 in the front-rear direction. This in turn makes it possible to secure the insertion and removal space 33 between the engine 14 located behind the control valve 32 and the control valve 32. Furthermore, attaching and detaching the spools 32*a* in the oblique direction as described above makes it possible to attach and detach the spools 32*a* in the narrow space.

Further, the present embodiment, in which the engine 14 includes the turbo mechanism 14*a*, yet makes it possible to perform maintenance on the spools 32*a* of the control valve 32, using the space under the turbo mechanism 14*a*. In other words, the present embodiment makes it possible to prevent the turbo mechanism 14*a* from obstructing the attachment and detachment of the spools 32*a*.

Further, the present embodiment makes it possible to insert and remove the spools 32*a* also in a detachment direction A' opposite to the detachment direction A of the control valve 32. Also in this case, the slewing motor 31 is not located in front of the spools 32*a* in the detachment direction A', and the space of a certain size is secured between the control valve 32 and the swivel joint 30. This makes it possible to facilitate the attachment and detachment of the spools 32*a*.

Further, the present embodiment makes it possible to perform maintenance on the spools 32*a* of the control valve 32, using the limited insertion and removal space 33 (FIGS. 3 and 4) defined under the turbo mechanism 14*a* and above the engine oil circulation piping 36 effectively.

As described above, in the hydraulic excavator 1 according to the present embodiment, the swivel joint 30 and the control valve 32 are disposed near the left vertical plate 22 and the slewing motor 31 is disposed near the right vertical plate 23, the control valve 32 being disposed with the detachment direction A of the plurality of spools 32*a* included therein extending obliquely in such a way as to get closer to the right vertical plate 23 as it goes rearward. This makes it possible to perform maintenance on the control valve 32 in the narrow space between the swivel joint 30 and the engine 14. It should be noted that the control valve 14, the swivel joint 30, and the slewing motor 31 disposed on the slewing frame 11 may alternatively be arranged such that the respective positions shown in the plan view of FIG. 1 are reversed in the left-right direction.

Other Embodiments

The above-described embodiment according to the present invention may be modified in the following ways.

In the above-described embodiment, the construction machine is in the form of the hydraulic excavator 1. However, the present invention can be applied to constriction machines other than the hydraulic excavator 1 that include a lower traveling body, a slewing frame rotatably mounted on the lower traveling body and having a pair of vertical plates disposed on the slewing frame, and an attachment supported on the pair of vertical plates in a raisable and lowerable manner, such as a crane.

In the above-described embodiment, the detachment direction A of the spools 32*a* is slightly oblique with respect to the straight line B connecting the center of the swivel joint 30 and the center of the slewing motor 31. However, the detachment direction A may extend in parallel to the straight line B. The oblique angle of the detachment direction A with respect to the pair of vertical plates 22 and 23 is not particularly limited, and may be varied according to the size of the insertion and removal space 33 and the length of the spools 32*a*, for example.

In the above-described embodiment, the L-shaped connector 37, formed by connecting a straight connector to an L-type connector, for example, is used as an extension connector. Such use of the extension connector extending downward makes it possible to hold the engine oil circulation piping 36 at the low position, keeping it away from the insertion and removal space 33. For example, in the case where the engine oil circulation piping 36 has a metal end portion bent in L-shape, a straight connector may be connected to the L-shaped metal end portion to form L-shaped piping extending downward as a whole. The piping may be bent in other shapes.

It should be understood that the above-described embodiment merely illustrates a preferred embodiment of the principle of the present invention, and is not intended to limit the application and use of the present invention in any way.

The present invention provides a construction machine, comprising: a lower traveling body; a slewing frame rotatably mounted on the lower traveling body about a rotational axis extending in an up-down direction, the slewing frame having an upper surface extending in a front-rear direction and a left-right direction; a first vertical plate and a second vertical plate disposed on the upper surface of the slewing frame at a distance from each other across the rotational axis in the left-right direction, each of the vertical plates extending in the front-rear direction and the first vertical plate being located closer to the rotational axis in the left-right direction than the second vertical plate; an attachment disposed forward of the rotational axis and supported on the first vertical plate and the second vertical plate in a raisable and lowerable manner; an engine mounted on a portion of the upper surface of the slewing frame located behind the first vertical plate and the second vertical plate; a swivel joint attached to the slewing frame such that the swivel joint lies on the rotational axis between the first vertical plate and the second vertical plate, the swivel joint being interposed between the lower traveling body and the slewing frame; a slewing motor mounted on a portion of the upper surface of the slewing frame located behind the swivel joint and closer to the second vertical plate than to the first vertical plate in the left-right direction, the slewing motor being configured to generate a driving force for rotating the slewing frame; and a control valve including a control valve body mounted on a portion of the upper surface of the slewing frame located behind and at a distance from the slewing motor and in front of and at a distance from the engine, the portion being located between the first vertical plate and the second vertical plate at a position closer to the first vertical plate than to the second vertical plate in the left-right direction, and a plurality of spools each detachably supported on the control valve body, the spools being detachable from the control valve body in a horizontal detachment direction through an attachment and detachment space defined between the control valve body and the engine, the detachment direction extending obliquely with respect to the front-rear direction in such a way as to bring the plurality of spools closer to the second vertical plate as the spools proceed rearward in the detachment direction.

The above-described configuration makes it possible to dispose the swivel joint, the slewing motor, and the control valve in the narrow space defined between the paired vertical plates to thereby sufficiently secure the attachment and detachment space for the spools of the control valve.

In the above-described configuration, it is preferable that the detachment direction of the plurality of spools extends along a straight line connecting a center of the swivel joint and a center of the slewing motor in plan view.

The above-described configuration makes it possible to effectively use the space defined behind the slewing motor located closer to the other one of the pair of vertical plates, as the attachment and detachment space for the spools of the control valve.

In the above-described configuration, it is preferable that the slewing motor is disposed at a position horizontally away from a plurality of straight lines passing through respective ones of the plurality of spools in plan view and extending in the detachment direction.

The above-described configuration makes it possible to effectively use the space defined behind the slewing motor located closer to the other one of the pair of vertical plates, as the attachment and detachment space for the spools of the control valve.

In the above-described configuration, it is preferable that the engine includes an engine body having a front surface facing forward in the front-rear direction, and a turbo mechanism attached to the front surface of the engine body, the turbo mechanism being disposed, in plan view, on at least one of a plurality of straight lines passing through respective ones of the plurality of the spools and extending in the detachment direction and, in side view as seen in the left-right-direction, above the at least one straight line.

Although the engine including the turbo mechanism tends to further reduce the space around the engine, the above-described configuration makes it possible to perform maintenance on the spools of the control valve, using the space under the turbo mechanism.

In the above-described configuration, it is preferable that the engine further includes an engine oil pan, disposed under the engine body, for containing an engine oil, and an engine oil pump disposed under the engine body in such a way as to overlap the attachment and detachment space in rear view of the slewing frame, the engine oil pump being configured to circulate the engine oil in the engine oil pan, and that the construction machine further comprises: an engine oil filter, disposed at a portion of the slewing frame located outside the second vertical plate in the left-right direction, for filtering the engine oil; and engine oil circulation piping for permitting flow of the engine oil between the engine oil pump and the engine oil filter, the engine oil circulation piping having one end portion connected to the engine oil pump and a guide pipe extending from the one end portion to the engine oil filter, passing through under the attachment and detachment space.

The above-described configuration makes it possible to perform maintenance on the spools of the control valve, using the limited space defined under the turbo mechanism and above the engine oil circulation piping effectively.

In the above-described configuration, it is preferable that the construction machine further comprises a pump casing disposed on a portion of the upper surface of the slewing frame located outside the engine in the left-right direction, the pump casing including a door openable to permit a worker to enter into the pump casing from outside the slewing frame; and a hydraulic oil pump disposed in the pump casing and configured to discharge a hydraulic oil, wherein the engine oil filter is disposed in the pump casing.

The invention claimed is:

1. A construction machine, comprising:

a lower traveling body;

a slewing frame rotatably mounted on the lower traveling body about a rotational axis extending in an up-down direction, the slewing frame having an upper surface extending in a front-rear direction and a left-right direction;

a first vertical plate and a second vertical plate disposed on the upper surface of the slewing frame at a distance from each other across the rotational axis in the left-right direction, each of the vertical plates extending in the front-rear direction and the first vertical plate being located closer to the rotational axis in the left-right direction than the second vertical plate;

an attachment disposed forward of the rotational axis and supported on the first vertical plate and the second vertical plate in a rai sable and lowerable manner;

an engine mounted on a portion of the upper surface of the slewing frame located behind the first vertical plate and the second vertical plate;

a swivel joint attached to the slewing frame such that the swivel joint lies on the rotational axis between the first vertical plate and the second vertical plate, the swivel joint being interposed between the lower traveling body and the slewing frame;

a slewing motor mounted on a portion of the upper surface of the slewing frame located behind the swivel joint and closer to the second vertical plate than to the first vertical plate in the left-right direction, the slewing motor being configured to generate a driving force for rotating the slewing frame; and a control valve including a control valve body mounted on a portion of the upper surface of the slewing frame located behind and at a distance from the slewing motor and in front of and at a distance from the engine, the portion being located between the first vertical plate and the second vertical plate at a position closer to the first vertical plate than to the second vertical plate in the left-right direction, and a plurality of spools each detachably supported on the control valve body, the spools being detachable from the control valve body in a horizontal detachment direction through an attachment and detachment space defined between the control valve body and the engine, the detachment direction extending obliquely with respect to the front-rear direction in such a way as to bring the plurality of spools closer to the second vertical plate as the spools proceed rearward in the detachment direction.

2. The construction machine according to claim 1, wherein the detachment direction of the plurality of spools extends along a straight line connecting a center of the swivel joint and a center of the slewing motor in plan view.

3. The construction machine according to claim 1, wherein the slewing motor is disposed at a position horizontally away from a plurality of straight lines passing through respective ones of the plurality of spools in plan view and extending in the detachment direction.

4. The construction machine according to claim 1, wherein the engine includes an engine body having a front surface facing forward in the front-rear direction, and a turbo mechanism attached to the front surface of the engine body, the turbo mechanism being disposed, in plan view, on at least one of a plurality of straight lines passing through respective ones of the plurality of the spools and extending in the detachment direction and, in side view as seen in the left-right-direction, above the at least one straight line.

5. The construction machine according to claim 4, wherein the engine further includes an engine oil pan, disposed under the engine body, for containing an engine oil, and an engine oil pump disposed under the engine body in such a way as to overlap the attachment and detachment space in rear view of the slewing frame, the engine oil pump being configured to circulate the engine oil in the engine oil pan, the construction machine further comprising:

an engine oil filter, disposed at a portion of the slewing frame located outside the second vertical plate in the left-right direction, for filtering the engine oil; and engine oil circulation piping for permitting flow of the engine oil between the engine oil pump and the engine oil filter, the engine oil circulation piping having one end portion connected to the engine oil pump and a guide pipe extending from the one end portion to the engine oil filter, passing through under the attachment and detachment space.

6. The construction machine according to claim 5, further comprising:

a pump casing disposed on a portion of the upper surface of the slewing frame located outside the engine in the left-right direction, the pump casing including a door openable to permit a worker to enter into the pump casing from outside the slewing frame; and a hydraulic oil pump disposed in the pump casing and configured to discharge a hydraulic oil, wherein the engine oil filter is disposed in the pump casing.

* * * * *